US011578879B2

(12) United States Patent
Zhou et al.

(10) Patent No.: US 11,578,879 B2
(45) Date of Patent: Feb. 14, 2023

(54) WINDOW-TYPE AIR CONDITIONER

(71) Applicant: QINGDAO HAIER AIR CONDITIONER GENERAL CORP., LTD., Shandong (CN)

(72) Inventors: Shutao Zhou, Qingdao (CN); Qiang Zhang, Qingdao (CN); Wenquan Song, Qingdao (CN); Yanfei Wang, Qingdao (CN); Baifa Zhu, Qingdao (CN); Guangbao Qiao, Qingdao (CN); Ruofeng Wang, Qingdao (CN)

(73) Assignees: CHONGQING HAIER AIR CONDITIONER CO., LTD., Chongqing (CN); QINGDAO HAIER AIR CONDITIONER GENERAL CORP., LTD., Qingdao (CN)

( * ) Notice: Subject to any disclaimer, the term of this patent is extended or adjusted under 35 U.S.C. 154(b) by 208 days.

(21) Appl. No.: 16/650,724

(22) PCT Filed: Sep. 18, 2018

(86) PCT No.: PCT/CN2018/106311
§ 371 (c)(1),
(2) Date: Mar. 25, 2020

(87) PCT Pub. No.: WO2019/062607
PCT Pub. Date: Apr. 4, 2019

(65) Prior Publication Data

US 2020/0278122 A1 Sep. 3, 2020

(30) Foreign Application Priority Data

Sep. 30, 2017 (CN) ..... 201710917589.5

(51) Int. Cl.
*F24F 1/0323* (2019.01)
*F24F 1/031* (2019.01)
*F24F 13/20* (2006.01)

(52) U.S. Cl.
CPC ..... *F24F 1/0323* (2019.02); *F24F 1/031* (2019.02); *F24F 13/20* (2013.01); *F24F 2013/205* (2013.01)

(58) Field of Classification Search
CPC ..... F24F 1/0323; F24F 1/031; F24F 13/20; F24F 2013/205
See application file for complete search history.

(56) References Cited

U.S. PATENT DOCUMENTS 7,818,974 B2 10/2010 Kim et al.
9,696,044 B2 7/2017 Shaffer et al.
(Continued)

FOREIGN PATENT DOCUMENTS

CN 1542329 A 11/2004
CN 1727768 A 2/2006
(Continued)

OTHER PUBLICATIONS

CN106016487A Translation (Year: 2016).*
(Continued)

*Primary Examiner* — Schyler S Sanks
(74) *Attorney, Agent, or Firm* — Alston & Bird LLP

(57) ABSTRACT

A window type air conditioner includes an indoor heat exchanger, an outdoor heat exchanger and a motor disposed in the shell. Rotating shafts at two ends of the motor are provided with an indoor fan and an outdoor fan. A thermal insulation partition is disposed on a bottom plate of the shell and divides the shell into an indoor side and an outdoor side. The thermal insulation partition includes a front clapboard fixed on the bottom plate of the shell and a thermal insula-
(Continued)

tion volute disposed on the front clapboard. The indoor heat exchanger and the indoor fan are located in the thermal insulation volute. An integrated bracket is provided with a first mounting part for mounting and fixing the outdoor heat exchanger, a second mounting part for mounting and fixing the motor, and third mounting parts for connecting and fixing the front clapboard.

7 Claims, 8 Drawing Sheets

(56) References Cited

U.S. PATENT DOCUMENTS

| | | | | |
|---|---|---|---|---|
| 2003/0084682 | A1* | 5/2003 | Choi | F04D 29/4226 62/262 |
| 2016/0102871 | A1* | 4/2016 | Yamasari | F24F 1/0025 165/122 |

FOREIGN PATENT DOCUMENTS

| | | | | |
|---|---|---|---|---|
| CN | 203396042 | U | | 1/2014 |
| CN | 204757175 | | | 11/2015 |
| CN | 106016487 | | | 10/2016 |
| CN | 106016487 | A | * | 10/2016 |
| CN | 205641445 | U | | 10/2016 |
| CN | 106246581 | A | | 12/2016 |
| CN | 106247473 | A | | 12/2016 |
| CN | 106885358 | | | 6/2017 |
| CN | 106895497 | | | 6/2017 |
| CN | 207422454 | | | 5/2018 |
| CN | 207584932 | | | 7/2018 |
| CN | 207936330 | | | 10/2018 |
| JP | 62-119333 | | | 5/1987 |

OTHER PUBLICATIONS

PCT/CN2018/0106311 International Search Report dated Dec. 24, 2018.

Search Report for China Application No. 201710917589.5 dated May 13, 2022 (1 page).

* cited by examiner

WINDOW-TYPE AIR CONDITIONER

CROSS-REFERENCE TO RELATED APPLICATIONS

The present application is a national phase entry of International Application No. PCT/CN2018/106311, filed Sep. 18, 2018, which claims priority to Chinese Patent Application No. 201710917589.5, filed Sep. 30, 2017, which are incorporated herein by reference in their entirety.

FIELD OF THE INVENTION

The present invention relates to air conditioning equipment, and particularly relates to a window type air conditioner.

BACKGROUND OF THE INVENTION

Currently, a window type air conditioner is widely used because of its integrated structure for easy mounting. A compressor, a condenser, an evaporator and a motor are arranged in a shell of the window type air conditioner, wherein the motor coaxially drives indoor and outdoor fans to rotate. A Chinese patent (patent number: 201520484077.0) discloses a window type air conditioner, and a clapboard is disposed in a shell so as to divide the shell into an indoor side and an outdoor side, wherein a motor and a condenser are respectively located at the outdoor side and fixed on a bottom plate of the shell, and the clapboard is connected with an evaporator shield at the indoor side and a condenser shield at the outdoor side respectively through connecting columns so as to improve the connection reliability. However, in actual use processes, it was found that during transportation, the motor is prone to position deviation due to vibration, which will cause relative changes in positions of fans connected to two sides of the motor. In later use processes, the fans easily interfere with other parts, which will cause the phenomenon of abnormal noise or fan damage, so that the use reliability and the user experience are poor. How to design a window type air conditioner with high use reliability and user experience is a technical problem to be solved by the present invention.

BRIEF DESCRIPTION OF THE INVENTION

A technical problem to be solved by the present invention is to provide a window type air conditioner to realize the objectives of improving the use reliability and user experience of the window type air conditioner.

A technical scheme provided by the present invention is as follows: a window type air conditioner includes a shell and an indoor heat exchanger, an outdoor heat exchanger and a motor disposed in the shell, rotating shafts at two ends of the motor are correspondingly provided with an indoor fan and an outdoor fan, a thermal insulation partition is disposed on a bottom plate of the shell, the thermal insulation partition divides the shell into an indoor side and an outdoor side, the thermal insulation partition includes a front clapboard and a thermal insulation volute, the front clapboard is fixed on the bottom plate of the shell, the thermal insulation volute is disposed on the front clapboard, the indoor heat exchanger is disposed on the thermal insulation volute, the indoor fan is located in the thermal insulation volute, the window type air conditioner further includes an integrated bracket, the integrated bracket is configured to be provided with a first mounting part for mounting and fixing the outdoor heat exchanger, the integrated bracket is further configured to be provided with a second mounting part for mounting and fixing the motor, and the integrated bracket is further configured to be provided with third mounting parts for connecting and fixing the front clapboard.

Further, the integrated bracket includes a rear clapboard, a motor bracket and connecting columns and the rear clapboard, the motor bracket and the connecting columns are integrally formed, the motor bracket is formed on the rear clapboard, the connecting columns are formed on the motor bracket, the rear clapboard is the first mounting part, the motor bracket is the second mounting part, and the connecting columns are the third mounting parts.

Further, a support base is formed between the rear clapboard and a lower part of the motor bracket, and the support base is fixed on the bottom plate of the shell.

Further, a cantilever is formed between the rear clapboard and an upper part of the motor bracket.

Further, the rear clapboard is provided with a mounting hole, the outdoor fan is located in the mounting hole, a plurality of air induction plates are further disposed around the mounting hole, and the plurality of air induction plates form an air induction ring structure.

Further, the bottom plate of the shell is provided with a water receiving tray below the indoor heat exchanger.

Further, a plurality of support ribs are disposed in the water receiving tray, and a lower part of the indoor heat exchanger abuts against the support ribs.

Further, an air inlet and an air outlet are disposed on a front of the shell, a detachable air inlet grid is disposed at the air inlet, and a detachable air outlet frame is disposed in the air outlet.

According to the window type air conditioner provided by the present invention, the outdoor heat exchanger and the motor are mounted by adopting the integrated bracket, and the integrated bracket is also connected and fixed with the front clapboard, so that the position of the motor mounted on the integrated bracket is stable and reliable relative to the thermal insulation volute on the front clapboard and the mounting hole formed in the integrated bracket. In later transportation processes, it can ensure that the posture of the motor will not incline due to vibration or collision, ensure that the position of the indoor fan relative to the thermal insulation volute is stable, and ensure that the position of the outdoor fan relative to the mounting hole in the integrated bracket is stable at the same time, thereby avoiding abnormal noise caused by interference between the indoor fan and the thermal insulation volute due to the position change of the motor, reducing the noise, and improving the use reliability and the user experience.

BRIEF DESCRIPTION OF THE DRAWINGS

In order to illustrate technical schemes of embodiments of the present invention or in the prior art more clearly, accompanying drawings needing to be used in the description of the embodiments or the prior art are simply introduced below; and obviously, the accompanying drawings in the following description are some embodiments of the present invention, and those ordinarily skilled in the art can obtain other accompanying drawings without paying creative work according to these accompanying drawings.

DETAILED DESCRIPTION

For the purpose of making objects, technical schemes and advantages of embodiments of the present invention clearer, clear and complete description will be made to the technical schemes of the embodiments of the present invention in conjunction with accompanying drawings in the embodiments of the present invention. Obviously, the described embodiments are merely a part of the embodiments of the present invention and not all the embodiments. Based on the embodiments of the present invention, all other embodiments obtained by those ordinarily skilled in the art without paying creative work fall within the protection scope of the present invention.

Figure 1:
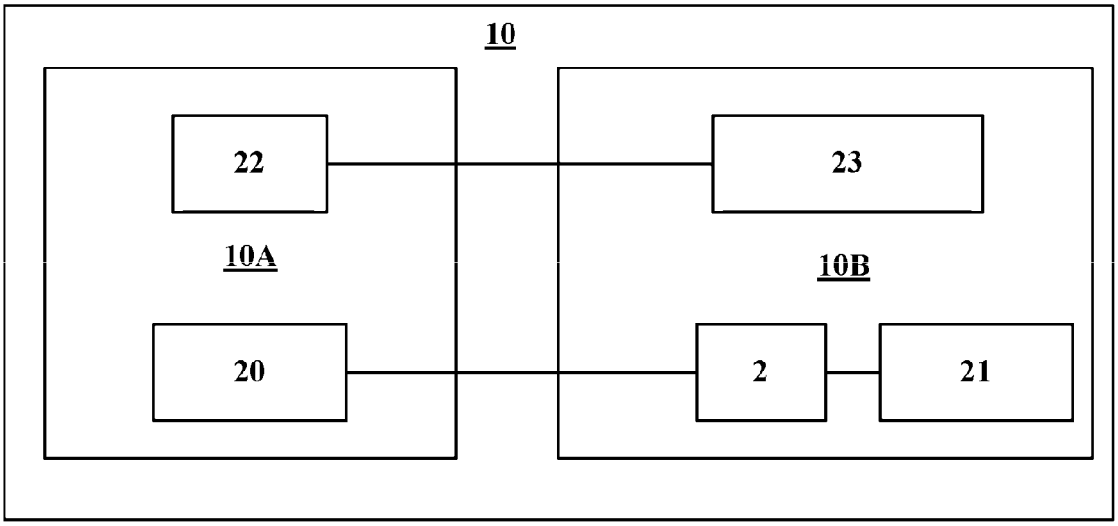
FIG. 1 is a schematic block diagram of a window type air conditioner according to an embodiment of the present invention.

Referring to FIG. 1, a window type air conditioner 10 provided by the present invention includes a shell and an indoor heat exchanger 22, an outdoor heat exchanger 23 and a motor 2 disposed in the shell. Rotating shafts at two ends of the motor are correspondingly provided with an indoor fan 20 and an outdoor fan 21. The shell is divided into an indoor side 10A and an outdoor side 10B. The indoor heat exchanger 22 is disposed at the indoor side. The indoor heat exchanger 22 is provided with the indoor fan. An air inlet and an air outlet are disposed on a front of the shell correspondingly. A detachable air inlet grid is disposed at the air inlet. A detachable air outlet frame is disposed in the air outlet. A compressor, the outdoor heat exchanger 23, the motor 2 and the outdoor fan 21 are disposed at the outdoor side. Different parts of the window type air conditioner provided by the present invention are improved respectively, and specific details are as follows:

Embodiment 1

Figure 2:
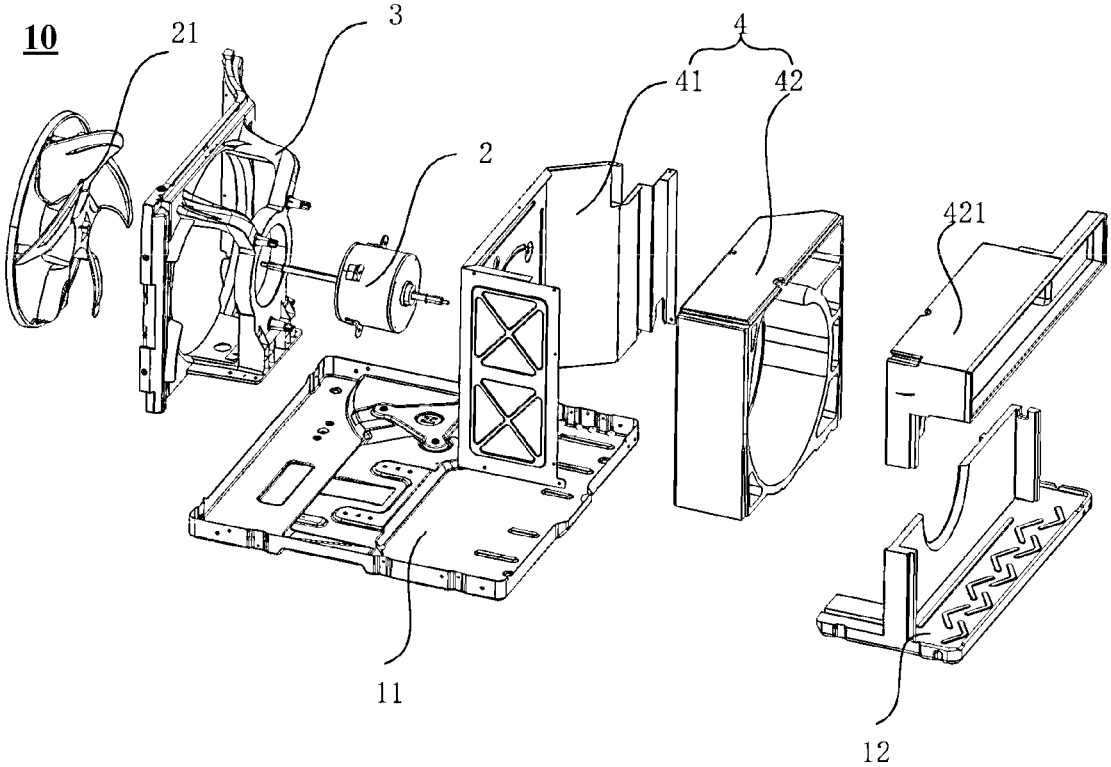
FIG. 2 is a partial exploded view of a window type air conditioner according to an embodiment of the present invention.
Figure 3:
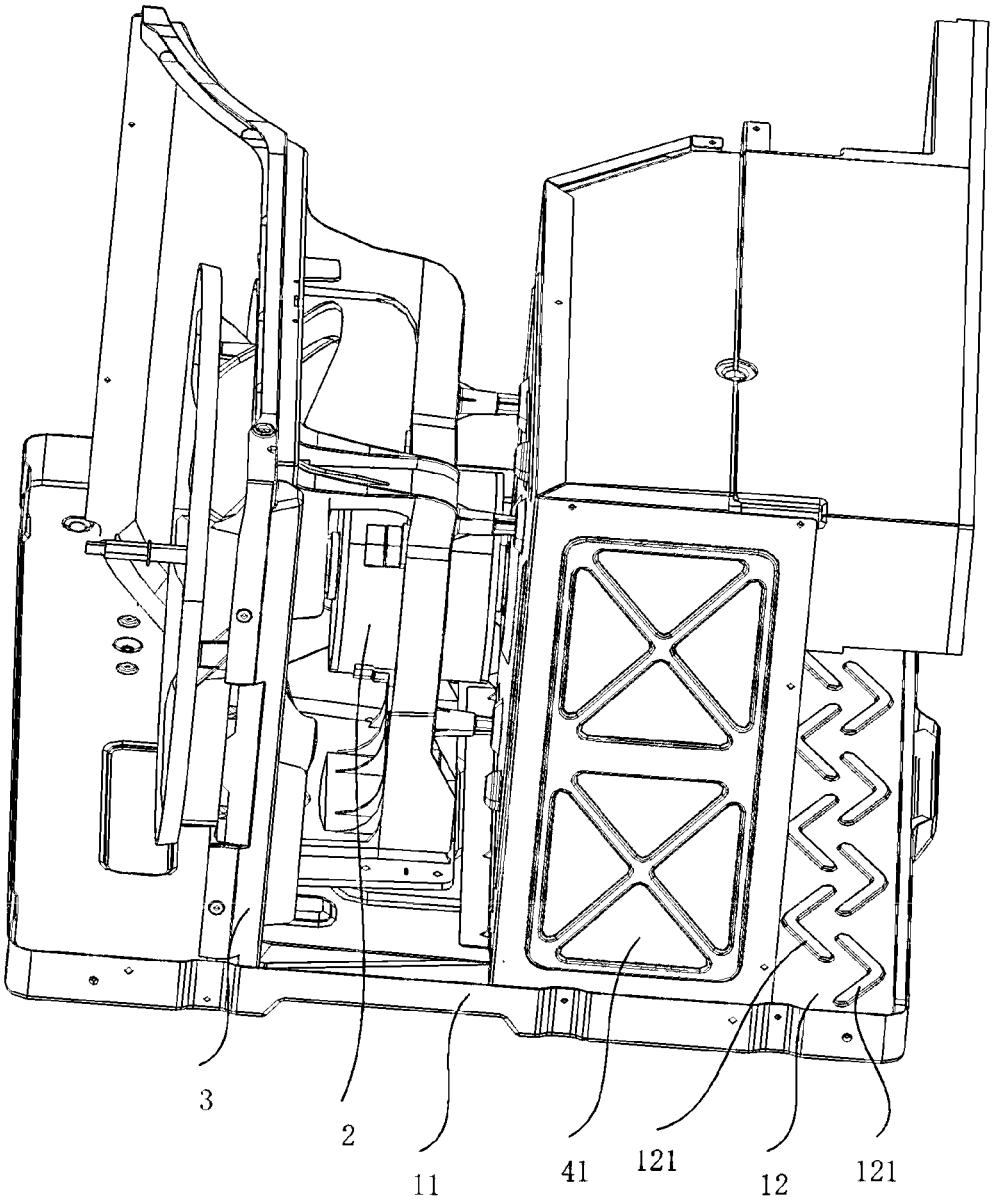
FIG. 3 is a partial schematic structural diagram I of a window type air conditioner according to an embodiment of the present invention.
Figure 4:
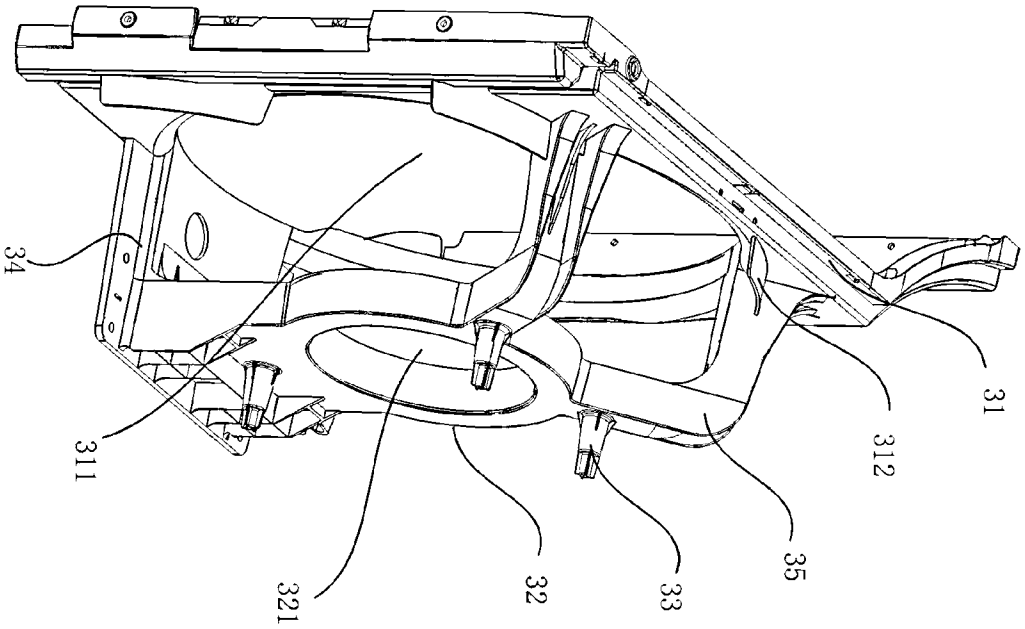
FIG. 4 is a schematic structural diagram of an integrated bracket in a window type air conditioner according to an embodiment of the present invention.
Figure 5:
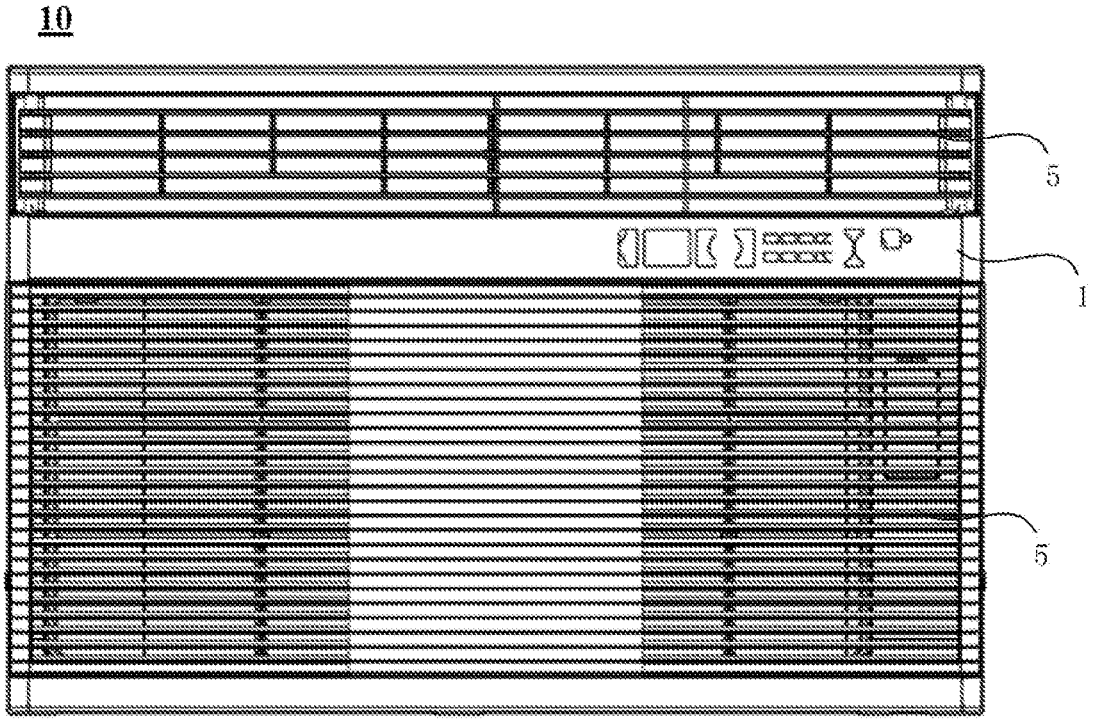
FIG. 5 is a front view of a window type air conditioner according to an embodiment of the present invention.
Figure 6:
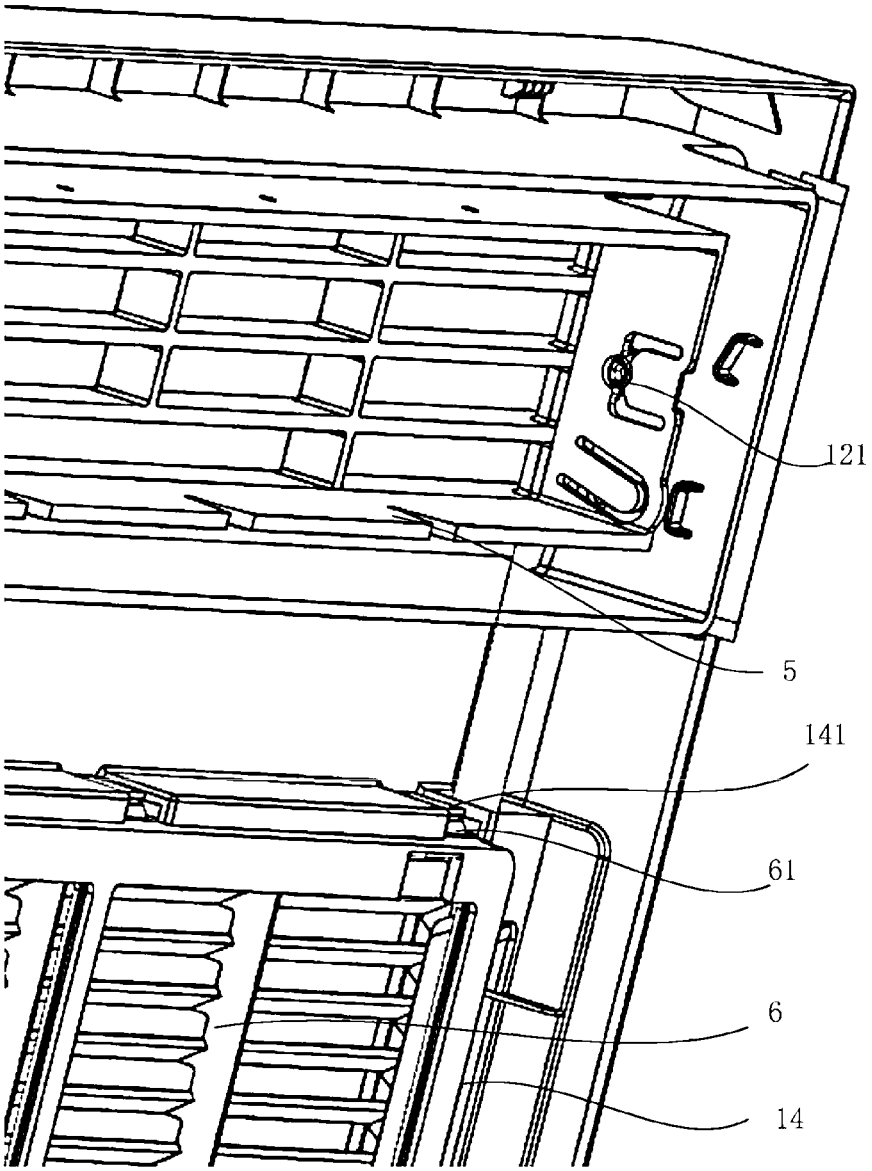
FIG. 6 is a partial assembly diagram of an air outlet frame and an air inlet grid in a window type air conditioner according to an embodiment of the present invention.
Figure 7:
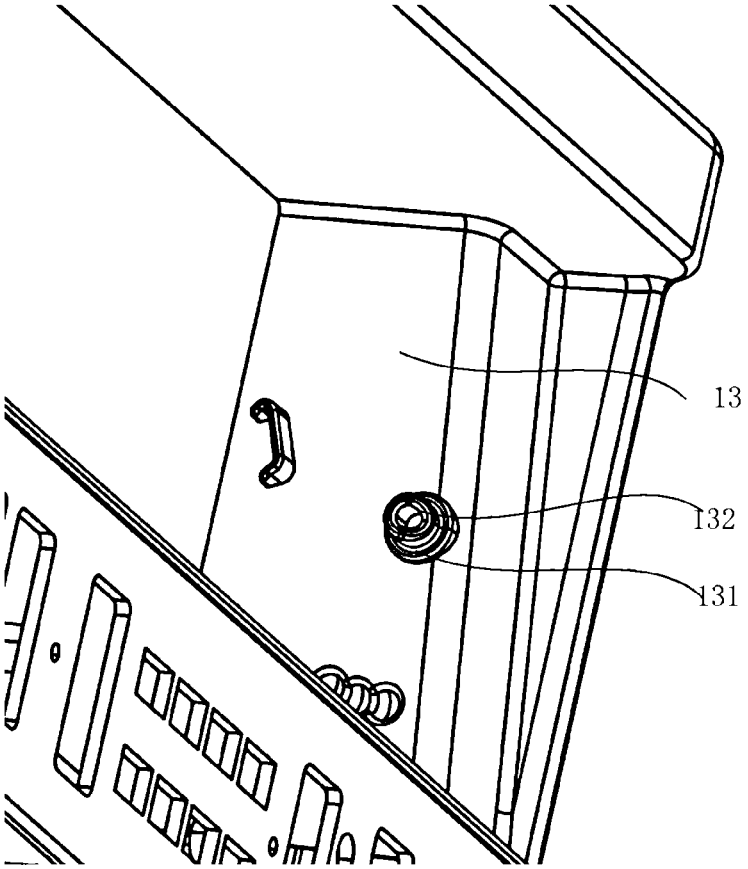
FIG. 7 is a partial schematic structural diagram of an air outlet in a window type air conditioner according to an embodiment of the present invention.
Figure 8:
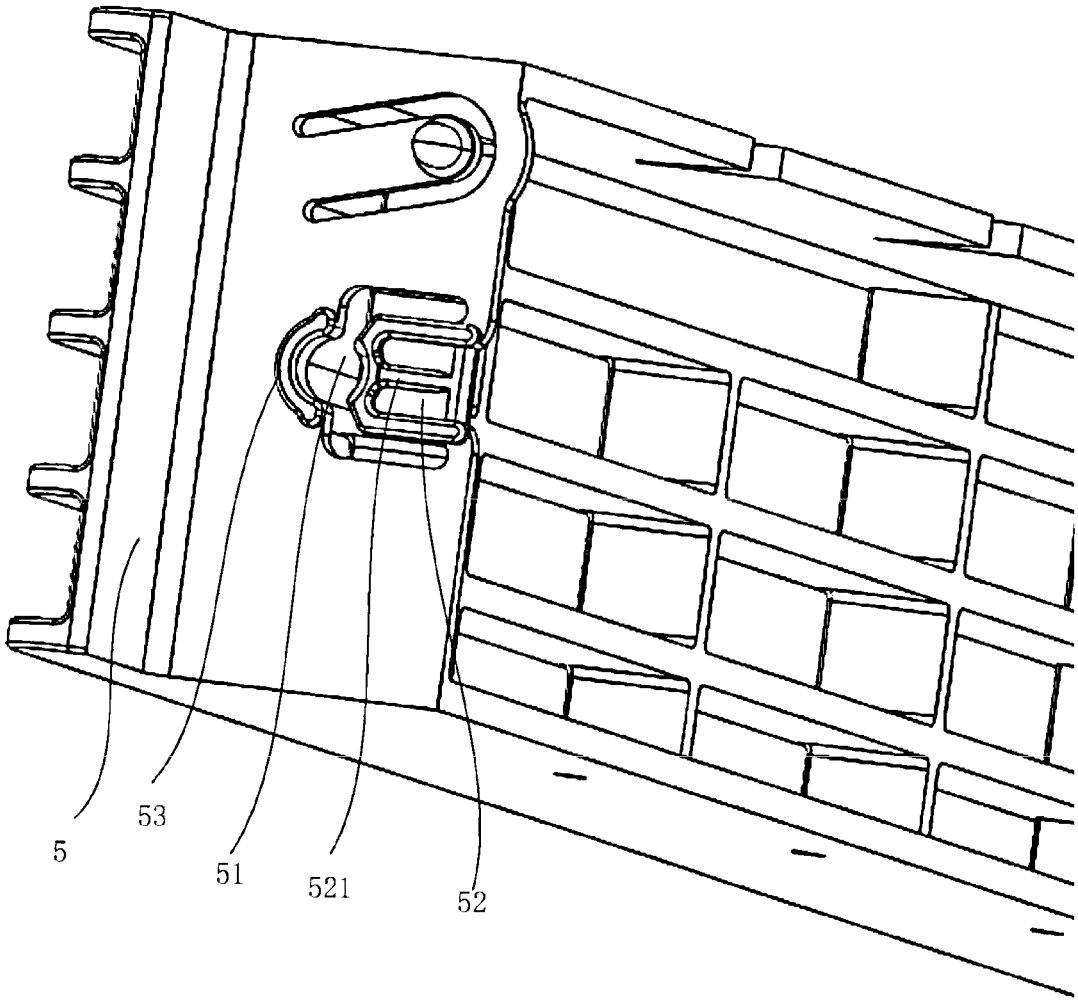
FIG. 8 is a partial schematic structural diagram of an air outlet frame in a window type air conditioner according to an embodiment of the present invention.
Figure 9:
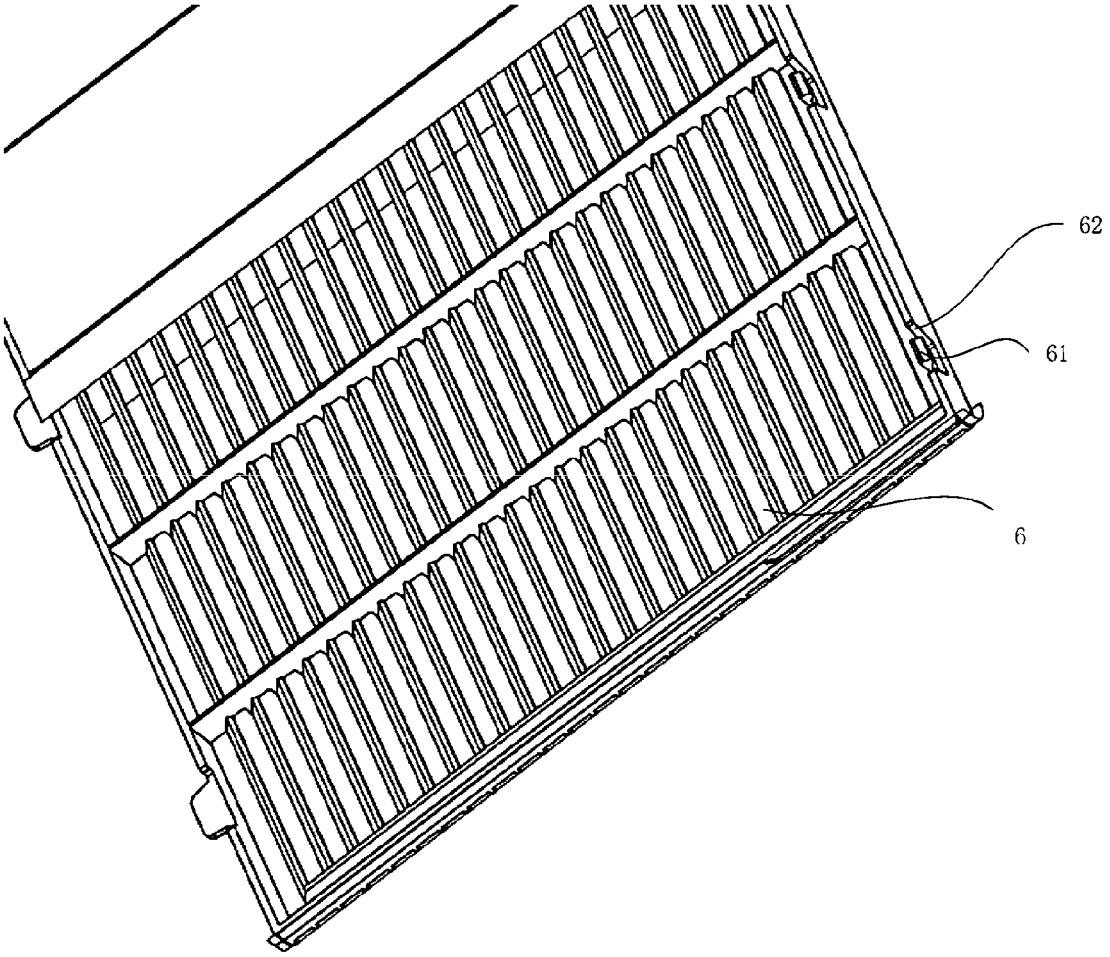
FIG. 9 is a partial schematic structural diagram of an air inlet grid in a window type air conditioner according to an embodiment of the present invention.

As shown in FIG. 2 to FIG. 4, in order to improve the mounting reliability of the motor 2, a thermal insulation partition 4 is disposed on a bottom plate 11 of a shell 1. The thermal insulation partition 4 divides the shell into an indoor side and an outdoor side. The thermal insulation partition 4 includes a front clapboard 41 and a thermal insulation volute 42. The front clapboard 41 is fixed on the bottom plate 11 of the shell. The thermal insulation volute 42 is disposed on the front clapboard 41. The indoor heat exchanger 22 is disposed on the thermal insulation volute 42. The indoor fan 20 is located in the thermal insulation volute 42. The window type air conditioner further includes an integrated bracket 3. The integrated bracket 3 is configured to be provided with a first mounting part for mounting and fixing the outdoor heat exchanger. The integrated bracket 3 is further configured to be provided with a second mounting part for mounting and fixing the motor 2. The integrated bracket 3 is further configured to be provided with third mounting parts for connecting and fixing the front clapboard 41.

Specifically, the outdoor heat exchanger and the motor 2 are mounted simultaneously by adopting the integrated bracket 3. The motor 2 is directly fixed on the integrated bracket 3 to ensure that the position of the motor 2 relative to the integrated bracket 3 is stable and reliable, and at the same time, the integrated bracket 3 is also connected and fixed with the front clapboard 41. On the whole, after the integrated bracket 3 and the front clapboard 41 are rigidly connected, the integrated bracket 3 and the front clapboard 41 will be relatively unchanged. Thus, the position of the motor 2 mounted on the integrated bracket 3 is stable and reliable relative to the thermal insulation volute 42 on the front clapboard 41. In later transportation processes, it can ensure that the posture of the motor 2 will not incline due to vibration or collision, ensure that the position of the indoor fan relative to the thermal insulation volute 42 is stable, and ensure that the position of the outdoor fan relative to an air port in the integrated bracket 3 is stable at the same time, thereby avoiding abnormal noise caused by interference to between the indoor fan and the thermal insulation volute 42 due to the position change of the motor 2, reducing the noise, and improving the use reliability. In actual use processes, the thermal insulation volute 42 is also connected with an air outlet channel 421, and indoor air is sucked into the shell and exchanges heat with the indoor heat exchanger, then enters the thermal insulation volute 42 and is output from the air outlet channel 421.

Further, the integrated bracket 3 includes a rear clapboard 31, a motor bracket 32 and connecting columns 33 and the rear clapboard, the motor bracket and the connecting columns are integrally formed. The motor bracket 32 is formed on the rear clapboard 31. The connecting columns 33 are formed on the motor bracket 32. The rear clapboard 31 is the first mounting part. The motor bracket 32 is the second mounting part. The connecting columns 33 are the third mounting parts. Specifically, the integrated bracket 3 may be processed by injection molding, welding and other modes. The rear clapboard 31 serves as the first mounting part for fixing the outdoor heat exchanger. At the same time, the rear clapboard 31 is provided with a mounting hole 311. The outdoor fan 21 is located in the mounting hole 311. A plurality of air induction plates 312 are further disposed around the mounting hole 311. The plurality of air induction plates 312 form an air induction ring structure. The motor bracket 32 is provided with a mounting hole 321. The motor 2 is fixed in the mounting hole 321. The connecting columns 33 are fixedly connected with the front clapboard 41 through screws. A plurality of connecting columns 33 may be disposed to be connected with the front clapboard 41 according to needs. Preferably, a support base 34 is formed between the rear clapboard 31 and a lower part of the motor bracket 32, and the support base 34 is fixed on the bottom plate 11 of the shell. Specifically, the integrated bracket 3 is mounted and fixed on the bottom plate 11 through the support base 34. The support base 34 can be firmly and reliably connected and fixed with the bottom plate 11, and the support base 34 also can better support and fix the rear clapboard 31 and the motor bracket 32. Furthermore, in order to improve the connection reliability of the motor 2, a cantilever 35 is formed between the rear clapboard 31 and an upper part of the motor bracket 32. The cantilever 35 and the support base 34 can improve the connection reliability of the rear clapboard 31 and the motor bracket 32, and improve the mounting stability of the motor 2 at the same time.

Embodiment 2

As shown in FIG. 2 and FIG. 3, the bottom of the indoor heat exchanger at the indoor side is further provided with a water receiving tray 12 on the bottom plate 11 of the shell. In order to prevent air from entering the thermal insulation volute 42 directly through the water receiving tray 12 without passing through the indoor heat exchanger so as to affect a refrigerating effect, a plurality of rows of support rib components are disposed in the water receiving tray 12. Each row of support rib components include a plurality of support ribs 121, and a lower part of the indoor heat exchanger abuts against the support ribs 121. Specifically, on the one hand, the support ribs 121 can carry the indoor heat exchanger in the water receiving tray 12, and on the other hand, the support ribs 121 can block the air entering a room so as to reduce the air at the indoor side from directly entering the thermal insulation volute 42 without being processed by the indoor heat exchanger. Preferably, for two adjacent rows of support rib components, an overlapping region is formed between the support ribs 121 in one row of support rib components and the corresponding support ribs 121 in the other row of support rib components in an air inlet direction. Specifically, the support ribs 121 are disposed in a gap formed between the indoor heat exchanger and the water receiving tray 12, and the overlapping region is formed between two adjacent rows of corresponding support ribs 121, so that air inlet resistance can be effectively increased, and an air leakage phenomenon can be improved to enhance the refrigerating effect. Further, the support ribs 121 may be of an arc-shaped structure, a V-shaped structure or a U-shaped structure. Corner staggered support ribs 121 are adopted to increase the air resistance without affecting the flow of condensed water in the water receiving tray 12, thereby greatly reducing the air leakage phenomenon and enhancing the refrigerating effect.

Embodiment 3

As shown in FIG. 5 to FIG. 9, aiming at a quick assembly mode of the air outlet frame 5, connecting shafts 131 are respectively disposed at two sides of the air outlet 13 of the shell 1. Shaft holes 51 are respectively disposed in two side walls of the air outlet frame 5. Guide slopes 132 are disposed at free ends of the connecting shafts. The connecting shafts 131 are clamped in the shaft holes 51 by means of the guide of the guide slopes 132. Specifically, by disposing the guide slopes 132 at the free ends of the connecting shafts 131, in the process of mounting the air outlet frame 5 in the air outlet 13, the two side walls of the air outlet frame 5 can be guided via the guide slopes 132, and finally, the connecting shafts 131 are clamped into the shaft holes 51 to realize the assembly of the air outlet frame 5. Because the guide slopes 132 are disposed on the connecting shafts 131, it is more convenient for an operator to move the air outlet frame 5 along the guide slopes 132, and finally, the connecting shafts 131 are inserted into the shaft holes 51.

Further, in order to make it easier for the operator to assemble the air outlet frame 5 and increase the disassembly difficulty of the air outlet frame 5 so as to prevent a user from disassembling the air outlet frame 5 at will, elastic plates 52 are further disposed on the side walls of the air outlet frame 5 and the elastic plates 52 are located at inner sides of the shaft holes 51. Specifically, in the process that the connecting shafts 131 enter the shaft holes 51, the connecting shafts 131 firstly abut against the elastic plates 52, and the elastic plates 52 are extruded by the connecting shafts 131 so as to be bent and deformed. After the connecting shafts 131 are clamped into the shaft holes 51, the elastic plates 52 are reset to block the connecting shafts 131 from being separated from the shaft holes 51. Slide rails 521 are formed on the elastic plates 52, and the heights of the slide rails 521 gradually increase in an air outlet direction. Corresponding to the formation of the elastic plates 52, two strip-shaped holes communicated with the shaft holes 51 may be formed in the side walls of the air outlet frame 5. Portions of the side walls of the air outlet frame 5 between the two strip-shaped holes form cantilever structures, and the cantilever structures form the elastic plates 52. Furthermore, positioning ribs 53 are further disposed on the side walls of the air outlet frame 5. The positioning ribs 53 are located at the inner sides of the shaft holes 51. The positioning ribs 53 are of an arc-shaped structure. The positioning ribs 53 are half-wrapped at outer sides of the shaft hole 51. In the process of mounting the air outlet frame 5 by the operator, the connecting shafts 131 can be limited by the convex positioning ribs 53, thereby increasing the assembly efficiency.

Embodiment 4

As shown in FIG. 5 to FIG. 9, aiming at a quick assembly mode of the air inlet grid 6, slots (not shown) are disposed at a bottom of the air inlet 14. First elastic claws 141 are disposed at an upper part of the air inlet 14. Bolts (not shown) are disposed at a bottom of the air inlet grid 6. Second elastic claws 61 are disposed at an upper part of the air inlet grid 6. The bolts are inserted into the slots, and the first elastic claws 141 and the second elastic claws 61 are clamped together. Specifically, the air inlet grid 6 is assembled on the air inlet 14 in a mode of clamping two elastic claws mutually, so that it is more convenient for an operator to more easily clamp the air inlet grid 6 in place, and the condition that the claws on the air inlet grid 6 easily interfere with edges of the air inlet 14 when the claws are clamped with the slots in conventional technologies can be avoided at the same time. After the air inlet grid 6 and the air inlet 14 are matched by the elastic claws, the air inlet grid is light in hand feeling and is still not easy to fall off, the hand feeling is highly tolerant to component tolerances, the hand feeling is uniform, and the assembly reliability is stable. Preferably, grooves 62 are disposed at a top of the air inlet grid 6, and the second elastic claws 61 are located in the grooves 62. Specifically, the second elastic claws 61 are located in the grooves 62 by adopting a sunken design to enable the second elastic claws 61 to be lower than a top surface of the air inlet grid 6, thereby better reducing a gap formed between the air inlet grid 6 and the air inlet 14, and optimizing an appearance effect to improve the user experience. The first elastic claws 141 extend towards the inside of the shell. The second elastic claws 61 extend towards the back of the air inlet grid 6. Front surfaces of the first elastic claws 141 are first guide surfaces. Back surfaces of the first elastic claws 141 are first positioning surfaces. Front surfaces of the second elastic claws 61 are second positioning surfaces. Back surfaces of the second elastic claws 61 are second guide surfaces. The gradients of the first guide surface and the second guide surface are less than the gradients of the first positioning surface and the second positioning surface. Specifically, the assembly and disassembly difficulty can be independently controlled by adjusting the gradients of the positioning surfaces and the guide surfaces, so that the assembly is easier, and the disassembly is more difficult.

It should be illustrated finally that the above embodiments are only used for illustrating the technical schemes of the present invention, and are not intended to limit the present invention; although the present invention is illustrated in detail with reference to the foregoing embodiments, it should be understood by those ordinarily skilled in the art that modifications may still be made on the technical schemes written by the foregoing embodiments, or equivalent replacements are made on part of technical features; and these modifications or replacements do not make the essence of the corresponding technical schemes break away from the spirit and scope of the technical scheme of the various embodiments of the present invention.

The invention claimed is:

1. A window type air conditioner, comprising a shell and an indoor heat exchanger, an outdoor heat exchanger and a motor disposed in the shell, wherein rotating shafts at two ends of the motor are correspondingly provided with an indoor fan and an outdoor fan, characterized in that a thermal insulation partition is disposed on a bottom plate of the shell, the thermal insulation partition divides the shell into an indoor side and an outdoor side, the thermal insulation partition comprises a front clapboard and a thermal insulation volute, the front clapboard is fixed on the bottom plate of the shell, the thermal insulation volute is disposed on the front clapboard, the indoor heat exchanger is disposed on the thermal insulation volute, the indoor fan is located in the thermal insulation volute, the window type air conditioner further comprises an integrated bracket, the integrated bracket is configured to be provided with a first mounting part for mounting and fixing the outdoor heat exchanger, the integrated bracket is further configured to be provided with a second mounting part for mounting and fixing the motor, and the integrated bracket is further configured to be provided with third mounting parts for connecting and fixing the front clapboard, wherein the bottom plate of the shell is provided with a water receiving tray below the indoor heat exchanger, and a plurality of rows of support rib components are disposed in the water receiving tray, and each row of support rib components comprise a plurality of support ribs;

wherein two adjacent rows of support rib components are configured as follows: an overlapping region is formed between the support ribs in one row of support rib components and the corresponding support ribs in the other row of support rib components in an air inlet direction; and wherein the support ribs are of an arc-shaped structure, a V-shaped structure or a U-shaped structure.

2. The window type air conditioner according to claim 1, wherein the integrated bracket comprises a rear clapboard, a motor bracket and connecting columns and the rear clapboard, the motor bracket and the connecting columns are integrally formed, the motor bracket is formed on the rear clapboard, the connecting columns are formed on the motor bracket, the rear clapboard is the first mounting part, the motor bracket is the second mounting part, and the connecting columns are the third mounting parts.

3. The window type air conditioner according to claim 2, wherein a support base is formed between the rear clapboard and a lower part of the motor bracket, and the support base is fixed on the bottom plate of the shell.

4. The window type air conditioner according to claim 3, wherein a cantilever is formed between the rear clapboard and an upper part of the motor bracket.

5. The window type air conditioner according to claim 2, wherein the rear clapboard is provided with a mounting hole, the outdoor fan is located in the mounting hole, a plurality of air induction plates are further disposed around the mounting hole, and the plurality of air induction plates form an air induction ring structure.

6. The window type air conditioner according to claim 1, wherein the plurality of support ribs are disposed in the water receiving tray, and a lower part of the indoor heat exchanger abuts against the support ribs.

7. The window type air conditioner according to claim 1, wherein an air inlet and an air outlet are disposed on a front of the shell, a detachable air inlet grid is disposed at the air inlet, and a detachable air outlet frame is disposed in the air outlet.

* * * * *